US009539851B1

(12) United States Patent
Tanda

(10) Patent No.: US 9,539,851 B1
(45) Date of Patent: Jan. 10, 2017

(54) CARRYING DEVICE FOR EASY TRANSPORT OF PAINT CANS

(71) Applicant: Aaron Tanda, Cranberry Township, PA (US)

(72) Inventor: Aaron Tanda, Cranberry Township, PA (US)

( * ) Notice: Subject to any disclaimer, the term of this patent is extended or adjusted under 35 U.S.C. 154(b) by 0 days.

(21) Appl. No.: 15/237,318

(22) Filed: Aug. 15, 2016

(51) Int. Cl.
*A45F 5/10* (2006.01)
*B44D 3/14* (2006.01)

(52) U.S. Cl.
CPC ..... *B44D 3/14* (2013.01); *A45F 5/102* (2013.01)

(58) Field of Classification Search
CPC A45F 5/102; A45F 5/1026; A45F 2005/1033; A45F 2005/1073; B44D 3/14
USPC ..... 294/159, 162, 165, 166, 170
See application file for complete search history.

(56) References Cited

U.S. PATENT DOCUMENTS 3,262,727 A * 7/1966 Blackaby ..... A45F 5/10 294/15
3,680,752 A * 8/1972 Wilson ..... A45F 5/10 294/171
4,420,178 A * 12/1983 Taylor ..... A45F 5/1026 229/117.19
5,836,634 A * 11/1998 Finkelman ..... A45F 5/1026 294/159
6,575,513 B2 * 6/2003 Pikel ..... A45F 5/10 294/159
D489,618 S * 5/2004 Startek ..... D9/434
7,047,604 B2 * 5/2006 Axel ..... A01K 27/00 16/422
7,533,916 B2 * 5/2009 Eichenbaum ..... A45F 5/1026 294/159
9,113,737 B2 * 8/2015 Goldstein ..... A47G 25/743

FOREIGN PATENT DOCUMENTS

FR 2733967 * 11/1996
WO WO 81/03008 * 10/1981
WO WO 2015/167662 * 11/2015

* cited by examiner

*Primary Examiner* — Dean Kramer
(74) *Attorney, Agent, or Firm* — Acker Wood IP Law, LLC; Gwen R. Acker Wood

(57) ABSTRACT

The present invention provides a carrying device and method to easily carry several paint cans at a time from one location to another. The device comprises a carriage and a plurality of handle attachments for securing a plurality of paint cans thereto. The carriage comprises an upper portion continuous with a lower portion, a central opening and a plurality of cavities located on the lower portion, each of which houses each of the plurality of handle-attachments therein. The upper portion of the carriage has a plurality of finger indentations for a user to place fingers when holding the device so that carrying the device is easy and comfortable. The device is configured so that the plurality of paint cans is balanced evenly across the length of the device to prevent tipping of the device as well as to increase the ease of carrying the paint cans.

11 Claims, 5 Drawing Sheets

CARRYING DEVICE FOR EASY TRANSPORT OF PAINT CANS

FIELD OF THE INVENTION

The present invention relates to carrying devices in general and, in particular, to a carrying device to easily and comfortably transport a plurality of paint cans at one time from one location to another location.

BACKGROUND OF THE INVENTION

When painting a structure, whether indoors or outdoors, most paint jobs require the use of several cans of paint. Typically, the paint cans are placed in a cardboard carton for transport from the place of purchase to the structure that is being painted. This requires an individual to pick up and carry the oftentimes heavy, cumbersome carton of paint cans to their vehicle, and then, upon reaching their destination, to again pick up and carry the heavy carton to the structure being painted. This also may require walking up steep walkways or a flights of stairs, which can be physically burdensome even for the strongest of individuals. There exists a need, therefore, for a carrying device to easily and comfortably transport several paint cans at a time from one location to another location without undue physical exertion and stress.

SUMMARY OF THE INVENTION

The present invention fulfills this need by providing a carrying device to easily and comfortably transport several paint cans at a time from one location to another.

In an aspect of the invention, there is provided a carrying device for easy transport of paint cans. The device is comprised of a carriage and a plurality of handle attachment means. The carriage is comprised of an upper portion continuous with a lower portion. The upper and lower portions have an inner surface and an outer surface, with the inner surface defining an interior opening therein. In the center of the inner surface of the upper portion of the carriage there are a plurality of indentations for a user to place their fingers when holding the device with their hand. Located on the outer surface of the lower portion of the carriage there are a plurality of housing units, or cavities, which contain the plurality of handle attachment means therein for securing the paint cans to the carriage, each handle attachment means affixed within each of the plurality of cavities.

The handle attachment means is comprised of a first arm and a second arm, wherein one end of the first arm is affixed within one end of the cavity, and the second arm is affixed within the other end of the cavity. The first arm is comprised of a stationary flange and a rotatable flange. The rotatable flange has a handle notch on its upper surface to accept a paint can handle of a paint can therein, and a mating recess and mating protrusion on its lower surface. The rotatable flange is connected to the stationary flange via a bolt which allows the rotatable flange to move upwardly so that the handle attachment means is in an open position, and to move downwardly so that the handle attachment means is in a closed position. The second arm is comprised of a stationary flange having a mating recess and a mating protrusion on its upper surface. When the handle attachment means is in the closed position, the mating recess of the rotatable flange fits onto the mating protrusion of the second arm, and the mating protrusion of the rotatable flange fits into the mating recess of the second arm.

The carrying device further comprises a plurality of attachment plates and attachment screws located on the outer surface of the lower portion of the carriage to affix the first and second arms of the plurality of handle attachment means within the plurality of cavities.

In another aspect of the invention, there is provided a method for easily carrying paint cans from one location to another using the above-described carrying device. The method comprises placing each of the plurality of handle attachment means in an open position by rotating upwardly each of the rotatable flanges; placing a paint can handle of a paint can into each of the handle notches; placing each of the plurality of handle attachment means in a closed position by rotating downwardly each of the rotatable flanges; having a user hold the device with one hand by placing their fingers in each of the plurality of finger indentations; and easily carrying the device with secured paint cans thereto from one location to another location.

BRIEF DESCRIPTION OF THE DRAWINGS

A fuller understanding of the invention can be gained from the following description when read in conjunction with the accompanying figures, where like reference numerals refer to identical or functionally similar elements throughout the separate views, which illustrate some, but not the only and exclusive, examples of embodiments of the invention and, as such, the figures disclosed herein are to be considered illustrative rather than limiting. In the drawings.

DETAILED DESCRIPTION OF THE INVENTION

Referring now to FIGS. 1-6, the carrying device for easy transport of paint cans of the present invention is shown generally throughout as 10.

Figure 1:
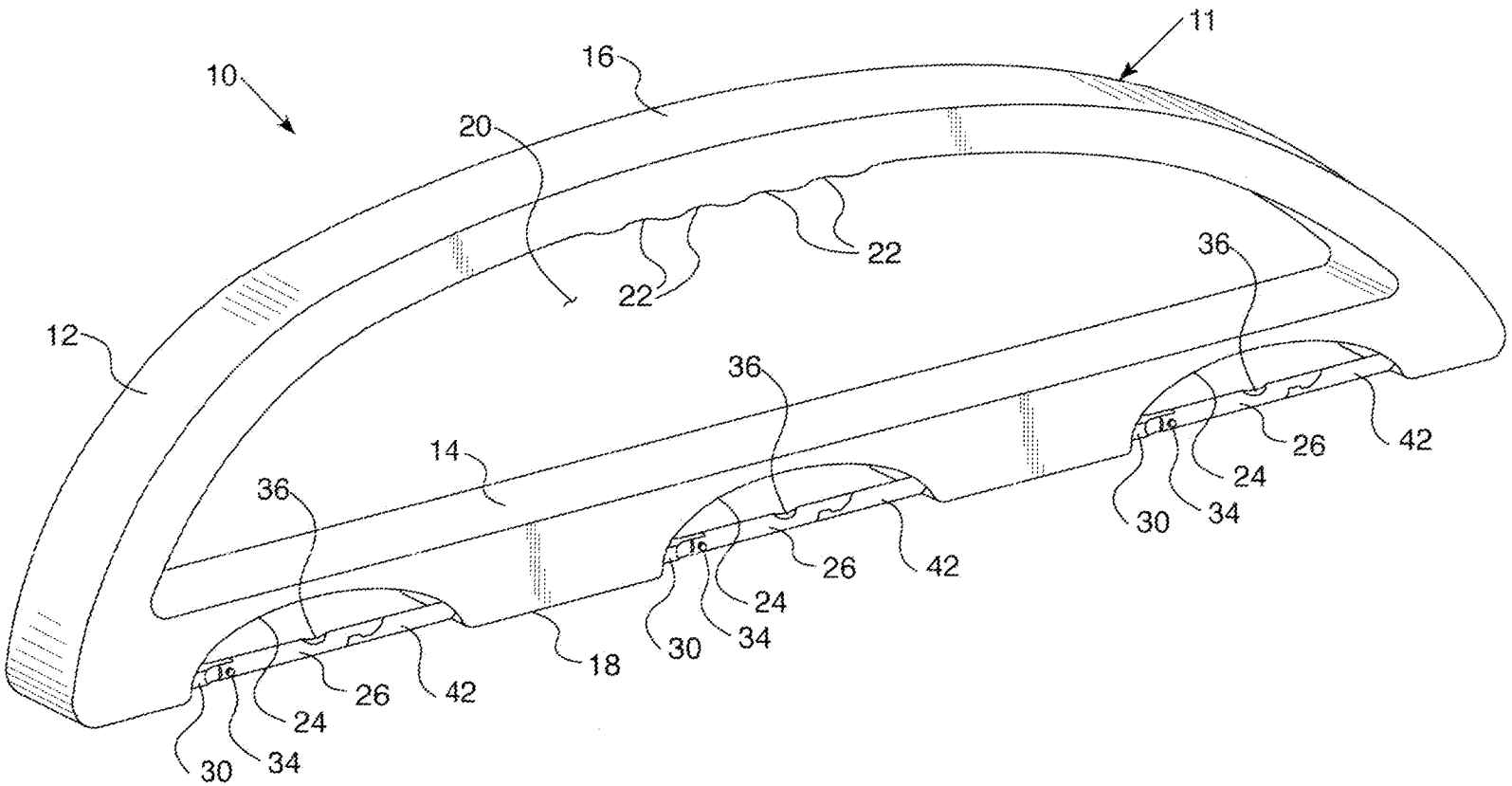
FIG. 1 is a perspective view of the carrying device, in accordance with an embodiment of the invention.

As shown in FIG. 1, the carrying device 10 comprises a carriage 11 and a plurality of handle attachment means 26. The carriage 11 is comprised of an upper portion 16 continuous with a lower portion 18. The upper and lower portions 16, 18 have an outer surface 12 and an inner surface 14, in which the inner surface 14 defines an interior opening 20 therein. In the center of the inner surface 14 of the upper portion 16, there are a plurality of finger indentations 22 configured to receive fingers of one hand of a user when the user is holding the device 10. In an embodiment, there are four closely-spaced ergonomically designed finger indentations 22 to receive each of four fingers of a user to allow the user to hold the device easily and comfortably.

In an embodiment (shown in FIGS. 1 and 2), the upper portion 16 of the carriage 11 is arcuate-shaped and the lower portion 18 is linear. The invention encompasses, however, other configurations in keeping with the spirit of the invention, such as, without limitation, an upper portion that is triangularly shaped and a lower portion that is bowed outwardly or inwardly (i.e. convexly or concavely).

In an embodiment, the cavities are dome-shaped (shown in FIGS. 1, 2, 5 and 6). In another embodiment, the cavities are 0 trilaterally shaped (not shown).

Figure 5:
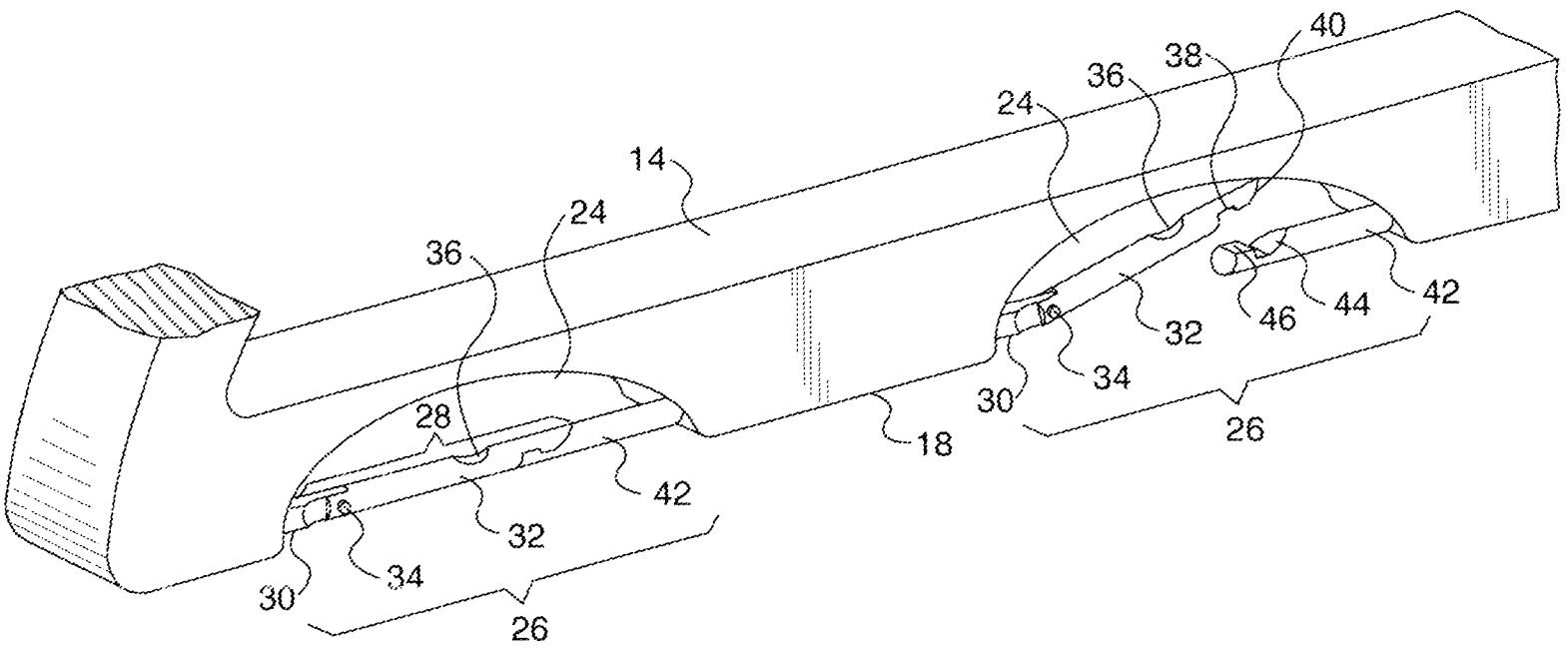
FIG. 5 is an enlarged partial perspective view of the bottom portion of the carrying device, in accordance with an embodiment of the invention.

As shown in FIGS. 1, 2, 5 and 6, a plurality of housing units, or cavities 24, are located on the outer surface 12 of the lower portion 18 of the carriage 11, each of the cavities 24 containing the handle attachment means 26 therein. As best seen in FIG. 5, the handle attachment means 26 is comprised of a first arm 28 and a second arm 42. The first arm 28 is comprised of a stationary flange 30 and a rotatable flange 32, the stationary flange 30 and rotatable flange 32 secured to one another with a bolt 34 which allows the rotatable flange 32 to move upwardly so that the handle attachments means 26 is in an open position (shown in center of FIG. 2 and on right side of FIG. 5), and to move downwardly so that the handle attachments means 26 is in a closed position (shown on left and right sides of FIG. 2 and left side of FIG. 5). The rotatable flange 32 has a handle notch 36 on its upper surface, and a mating recess 38 and mating protrusion 40 on its lower surface. The handle notch 36 is configured to accept a paint can handle thereon. The second arm 42 is stationary and has a mating recess 44 and a mating protrusion 46 on its upper surface. When the handle attachment means 26 is in the closed position, the mating recess 38 of the rotatable flange 32 fits onto the mating protrusion 46 of the second arm 42, and the mating protrusion 40 of the rotatable flange 32 fits into the mating recess 44 of the second arm 42.

Each of the cavities 24 has an opening at either end of the cavity (not shown) to which the ends of the handle attachment means 26 is placed therein. As best seen in FIG. 5, one end of the stationary flange 30 of the first arm 28 is affixed within the opening at one end of the cavity 24, and one end of the second arm 42 is affixed within the opening at the opposite end of the cavity 24.

Figure 3:
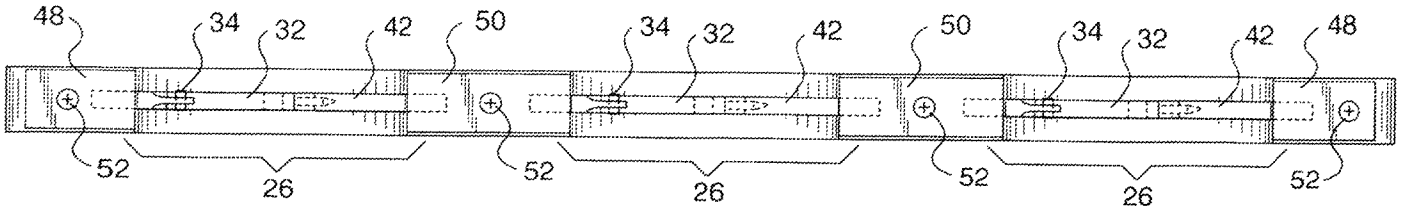
FIG. 3 is a bottom plan view of the lower portion of the carriage of the carrying device, in accordance with an embodiment of the invention.

As shown in FIG. 3, a plurality of attachment plates 50 are located on the lower portion 18 of the carriage 11. Each of the attachment plates 50 affixes the first and second arms 28, 42 of the handle attachment means 26 securely within each of the cavities 24.

Figure 4:
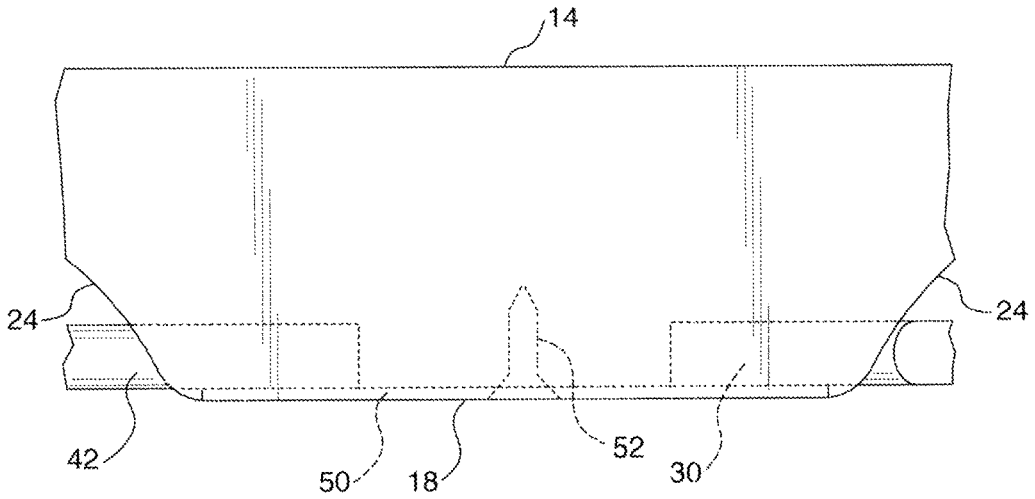
FIG. 4 is an enlarged front view of the lower portion of the carriage, in accordance with an embodiment of the invention.

As shown in FIG. 4, the attachment plate 50 is located on the lower portion 18 and is recessed slightly within the lower portion 18 to make direct contact with the stationary flange of the first arm 30 and the second arm 42 of the handle attachment means located within each cavity 24. Upon tightening the attachment plate screw 52, the stationary flange of the first arm 30 and the second arm 42 of the handle attachment means are affixed securely within each of the cavities 24.

Figure 2:
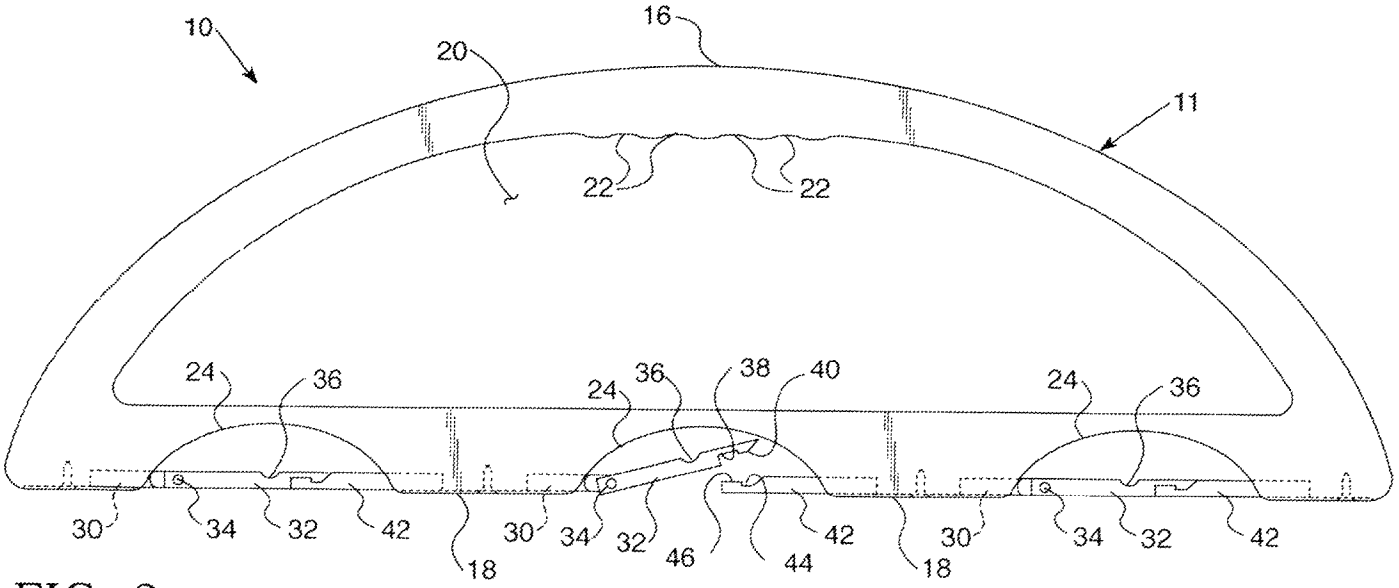
FIG. 2 is a frontal view of the carrying device, in accordance with an embodiment of the invention.

In an embodiment, as shown in FIGS. 2 and 3, the carriage 11 contains three cavities 24, each cavity 24 having a handle attachment means 26 therein to secure three paint cans 54, each paint can 54 having a diameter of about 6 to 7 inches and containing about one gallon of paint. The three handle attachment means 26 are affixed within the cavities 24 using two center attachment plates 50 and two end attachment plates 48 and four attachment plate screws 52.

In an embodiment (shown in FIGS. 1 and 2), there are four finger indentations which are ergonomically designed to allow for easy and comfortable holding of the device by a user while carrying the device from one location to another. The device is configured so that the plurality of paint cans secured by the device is balanced evenly across the length of the device to prevent tipping of the device when being carried, as well as to increase the ease of carrying the paint cans.

Figure 6:
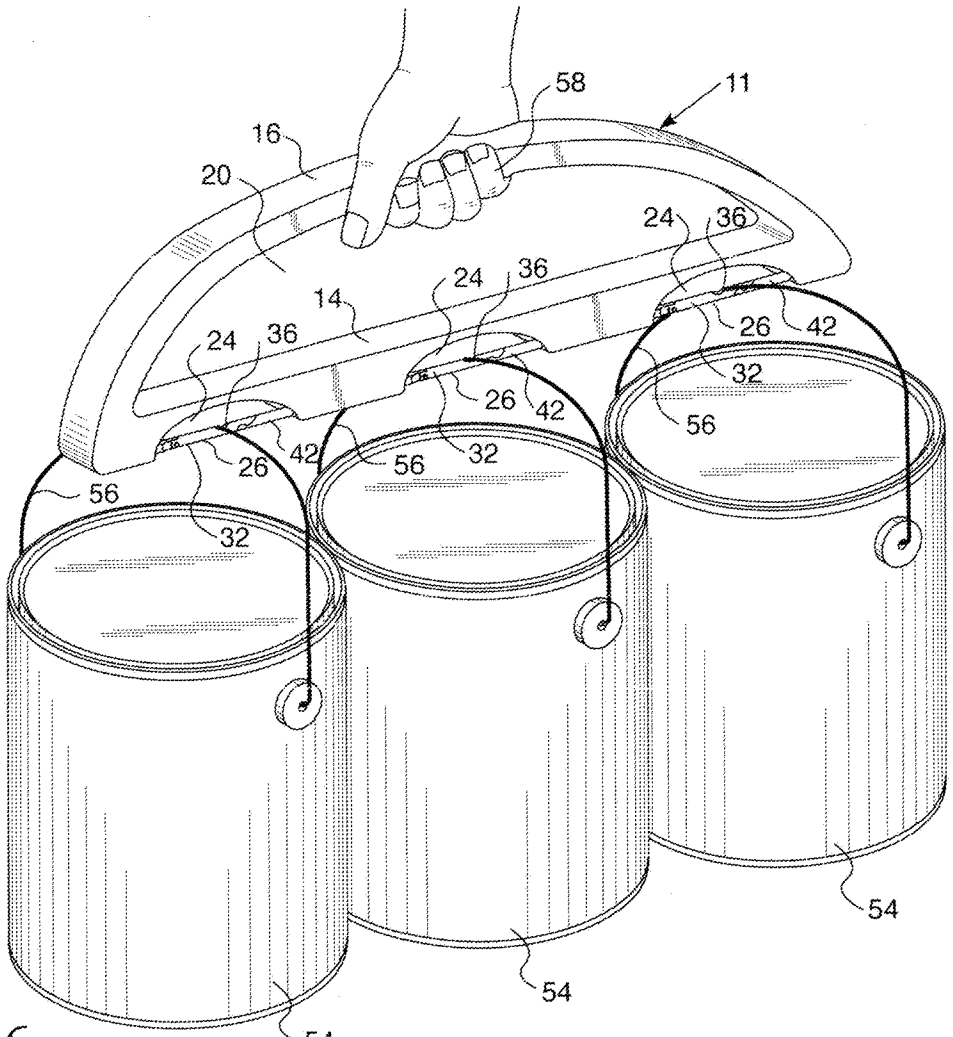
FIG. 6 is a perspective view of a user holding the carrying device with paint cans secured thereto, in accordance with an embodiment of the invention.

In use, as shown in FIG. 6, a paint can 54 is secured in each handle attachment means 26 by placing the paint can handle 56 into the notch 36 of the rotatable flange 32, and placing the handle attachment means 26 in a closed position. A user then holds the device 10 by placing the fingers 58 of one hand onto the plurality of finger indentations 22 (shown in FIGS. 1 and 2).

The device of the invention has a length of about 10.0 inches to about 20.0 inches. In an embodiment, the length of the device is about 14.0 inches. The distance between the upper portion and the lower portion of the device is about 3.0 inches to about 6.0 inches. In an embodiment, the distance between the upper portion and the lower portion of the device is about 4.0 inches. The width of the device is about 0.5 inches to about 2.0 inches. In an embodiment, the width of the device is about 0.75 inches.

The length of each of the plurality of cavities from one end to the other end is about 1.0 inch to about 4.0 inches. In an embodiment, the length of each of the plurality of cavities from one end to the other end is about 2.5 inches.

Suitable materials for manufacturing the carriage include, without limitation, plastics such as high density polyethylene, or metals such as steel, steel alloys, titanium, titanium alloys, tungsten, tungsten alloys and combinations thereof. In an embodiment, the carriage has an inner core of metal and an outer lining (i.e. is covered by) a plastic material.

Suitable materials for manufacturing the handle attachment means include, without limitation, metals such as steel, steel alloys, titanium, titanium alloys, tungsten, tungsten alloys, and combinations thereof.

It will be appreciated by those skilled in the art that changes could be made to the embodiments described above without departing from the broad inventive concept thereof. It is understood, therefore, that this invention is not limited to the particular embodiments disclosed, but it is intended to cover modifications that are within the spirit and scope of the invention, as defined by the appended claims.

What is claimed is:

1. A carrying device for easy transport of a plurality of paint cans from one location to another, the device comprising:

a carriage comprising:

an upper portion continuous with a lower portion, said upper and lower portions having an inner surface and an outer surface, said inner surface defining an interior opening therein;

a plurality of indentations in the center of the inner surface of the upper portion of the device for a user to place their fingers when holding the device with their hand;

a plurality of cavities located on the outer surface of the lower portion of the device; and a plurality of handle attachment means, each of said plurality of handle attachment means comprised of a first arm and a second arm, wherein one end of the first arm is affixed within one end of one of the plurality of cavities, and one end of the second arm is affixed within the other end of the plurality of cavities, each of the plurality of handle attachment means having a handle notch thereon for accepting a paint can handle of a paint can therein to secure the paint can to the carriage, each handle attachment means located in one of the plurality of cavities.

2. The carrying device of claim 1, further comprising a plurality of attachment plates and attachment screws located on the outer surface of the lower portion of the carriage and recessed therein to affix the first and second arms securely within the cavities.

3. The carrying device of claim 2, wherein the plurality of attachment plates comprises two small attachment plates and two large attachment plates.

4. The carrying device of claim 1, wherein the first arm is comprised of a stationary flange and a rotatable flange, said rotatable flange having a handle notch on its upper surface and a mating recess and mating protrusion on its lower surface, said rotatable flange connected to the stationary flange via a bolt which allows the rotatable flange to move upwardly so that the handle attachments means is in an open position, and to move downwardly so that the handle attachments means is in an closed position; and wherein the second arm is comprised of a stationary flange having a mating recess and a mating protrusion on its upper surface.

5. The carrying device of claim 4, wherein when the handle attachment means is in the closed position, the mating recess of the rotatable flange fits onto the mating protrusion of the second arm and the mating protrusion of the rotatable flange fits into the mating recess of the second arm.

6. A method to easily carry paint cans from one location to another using the device of claim 4, said method comprising:

placing each of the plurality of handle attachment means in an open position by rotating upwardly each of the rotatable flanges;

placing a paint can handle of a paint can in each of the handle notches;

placing each of the plurality of handle attachment means in a closed position by rotating downwardly each of the rotatable flanges;

having a user hold the device with one hand by placing each of their fingers in each of the plurality of indentations on the inner surface of the upper portion of the device; and carrying the device with attached paint cans from one location to another.

7. The method of claim 6, wherein the device comprises three handle attachment means to secure three paint cans thereto.

8. The carrying device of claim 1, wherein the device comprises three cavities and three handle attachment means.

9. The carrying device of claim 1, wherein the upper portion of the device is arcuate-shaped or trilaterally-shaped, and the lower portion of the device is linear, bowed outwardly or bowed inwardly.

10. The carrying device of claim 1, wherein the cavities are dome-shaped or trilaterally-shaped.

11. The carrying device of claim 1, wherein the inner surface of the upper portion of the device contains four indentations.

* * * * *